US006374576B1

(12) United States Patent
Baini

(10) Patent No.: US 6,374,576 B1
(45) Date of Patent: Apr. 23, 2002

(54) CAPPING METHOD AND CAPPING APPARATUS, IN PARTICULAR FOR CAPPING CONTAINERS WITH CROWN CAPS

(75) Inventor: Stefano Baini, Langhirano (IT)

(73) Assignee: Sasib S.p.A., Parma (IT)

( * ) Notice: Subject to any disclaimer, the term of this patent is extended or adjusted under 35 U.S.C. 154(b) by 0 days.

(21) Appl. No.: 09/445,149

(22) PCT Filed: May 27, 1998

(86) PCT No.: PCT/IT98/00135

§ 371 Date: Mar. 6, 2000

§ 102(e) Date: Mar. 6, 2000

(87) PCT Pub. No.: WO98/55389

PCT Pub. Date: Dec. 10, 1998

(30) Foreign Application Priority Data

Jun. 6, 1997 (IT) ..... PR97A0037

(51) Int. Cl.[7] ..... B67B 3/10

(52) U.S. Cl. ..... 53/343; 53/324; 53/303; 53/339; 53/342

(58) Field of Search ..... 53/343, 304, 324, 53/339, 342, 306, 331

(56) References Cited

U.S. PATENT DOCUMENTS

| | | | | | |
|---|---|---|---|---|---|
| 3,807,133 | A | * | 4/1974 | Simonazzi | 53/306 |
| 4,205,502 | A | * | 6/1980 | Ahlers | 53/343 |
| 4,389,833 | A | * | 6/1983 | Knabe | 53/342 |
| 4,729,204 | A | * | 3/1988 | Weiss | 53/343 |
| 5,040,354 | A | * | 8/1991 | Ahlers et al. | 53/342 |
| 5,375,394 | A | * | 12/1994 | Heudecker | 53/343 |

FOREIGN PATENT DOCUMENTS

| | | |
|---|---|---|
| DE | 3915822 | 11/1990 |
| EP | 561 344 | 9/1993 |
| FR | 2 648 125 | 12/1990 |
| GB | 6603 | 7/1909 |
| NL | 7 801 225 | 11/1978 |

* cited by examiner

*Primary Examiner*—Rinaldi I. Rada
*Assistant Examiner*—Sameh Tawfik
(74) *Attorney, Agent, or Firm*—Pillsbury Winthrop LLP

(57) ABSTRACT

The invention falls within the sector of bottling plants. In a method for capping containers (2) with crown caps, the step of centering the cap is performed without the container (2), the cap being completely free to arrange itself in position on a movable magnetic element (4). The capping machine has capping means (7, 11) which are eccentric with respect to the capping axis (20) and positioned at a higher level than the zone for capping the container (2).

2 Claims, 3 Drawing Sheets

CAPPING METHOD AND CAPPING APPARATUS, IN PARTICULAR FOR CAPPING CONTAINERS WITH CROWN CAPS

This application is the national phase of international application PCT/IT98/00135 filed May 27, 1998 which designated the U.S.

BACKGROUND OF THE INVENTION

1. Field of the Invention

The present invention relates to a capping apparatus, in particular for capping containers with crown caps.

2. Description of the Related Art

In the sector of closing containers with crown caps, the Applicant has already used for years a capping system which involves traditional side feeding of the crown caps, which are attracted by a magnet mounted on the bottom of a first piston sliding inside a second it piston.

The second piston is shaped at the bottom so as to form a chamber with a conical or cylindrical recess, inside which centering of the cap occurs when the two pistons descend onto the container, which is supported by a fixed plate.

Basically both pistons descend initially onto the container; then, when the first piston or internal piston encounters the mouth of the container it stops, pressing against it and centering the cap, while the second piston or external piston continues its descending movement so as to perform fastening of the cap onto the mouth of the container. Means are provided in order to compensate for slight variations in height of the containers, of the order of about ±7 mm.

EP 0470360 also discloses a capping device for crown caps in which there is an internal piston containing a magnet and sliding together with an external piston during a first descending step, followed by a second step in which the internal piston remains at a standstill against the bottle, while the external piston continues further the downward movement, embracing the cap and the mouth of the bottle.

Both in the solution of the Applicant and in that of the aforementioned document, centering of the cap is performed in the presence of the container, and the container is supported by a plate or by a fixed surface.

A drawback of these constructional designs consists in the fact that if the bottle is not perfectly centered with respect to the conical recess (also called capping die) or if the crown cap is not perfectly centered on the magnetic piston, incorrect application of the cap may occur.

A further drawback consists in the fact that the axis of the container during capping coincides with the axis of the capping pistons and therefore in the case of lubricant escaping from the pistons, this may contaminate the container.

The latter drawback has, moreover, been solved by a capping device in which the bottle is axially displaced with respect to the capping pistons, on which the conical recess and the magnet support are mounted in cantilever fashion. The bottle rests on a fixed plate and the capping pistons are positioned below the bottle capping zone in an area of the machine which greatly limits the accessibility thereof, complicating the maintenance operations.

BRIEF SUMMARY OF THE INVENTION

The object of the present invention is to eliminate the abovementioned drawbacks and provide a capping apparatus which allows pre-centering of the cap to be performed without the presence of the bottle.

Said objects are fully achieved by the capping machine forming the subject of the present invention, which is characterized by the contents of the claims below.

The capping machine comprises a first movable element coaxial with the capping axis and carrying at the bottom a magnet for attracting a cap; a second movable element coaxial with the capping axis and sliding outside the first movable element, together therewith and with respect thereto; means, which are eccentric with respect to the capping axis, for actuating the first and the second movable element; and is characterized in that said means are positioned at a higher level than the container capping zone.

Said means consist of a first piston and a second piston which are coaxial with one another and connected to the first and second movable element by means of arms.

BRIEF DESCRIPTION OF THE DRAWINGS

These and other characteristic features will emerge more clearly from the following description of a preferred embodiment illustrated, purely by way of a non-limiting example, in the accompanying illustrative plates in which.

DETAILED DESCRIPTION OF THE INVENTION

Figure 1:
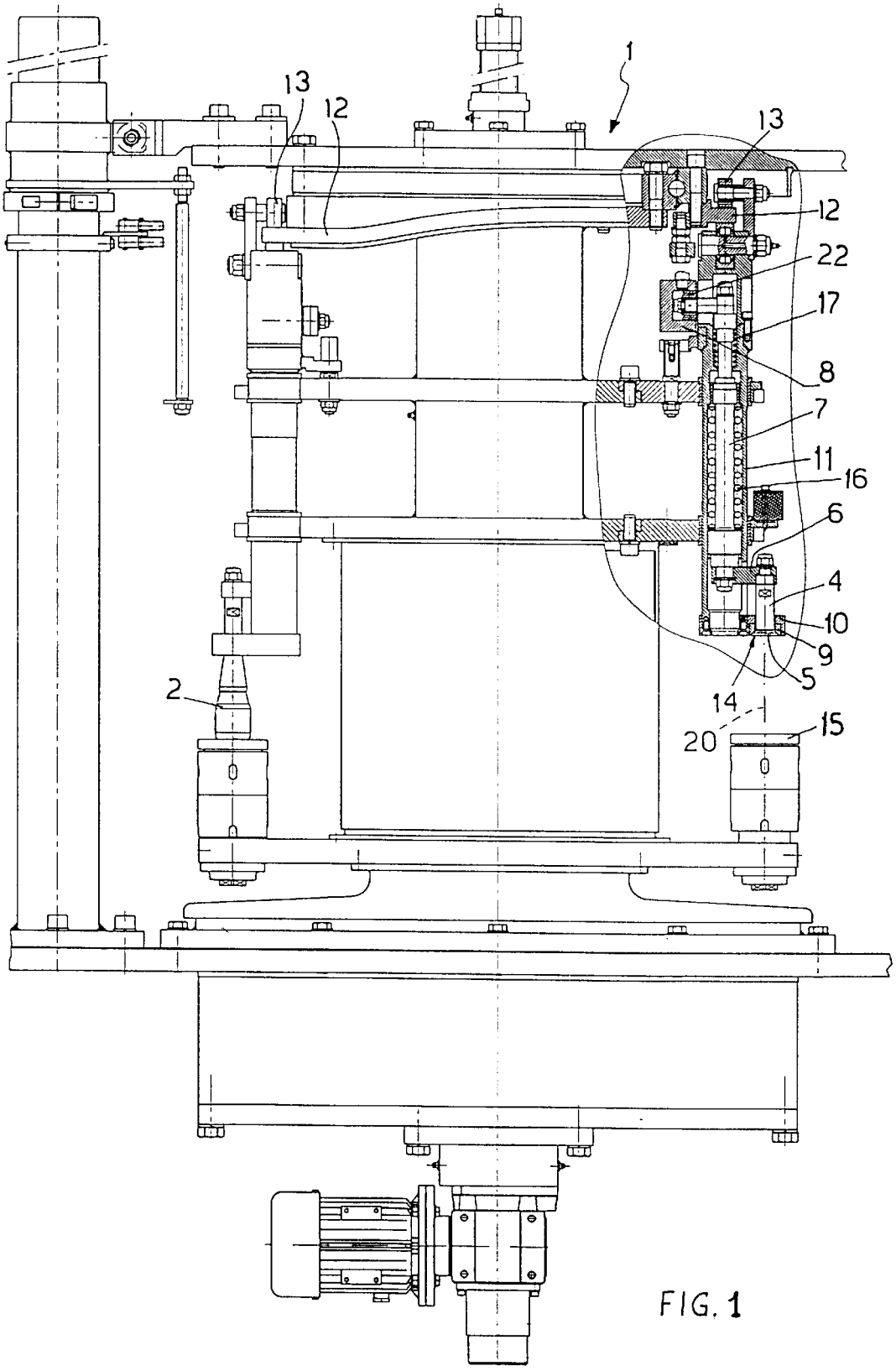
FIG. 1 shows a vertically sectioned overall view of the capping machine.

With reference to the Figures, 1 denotes in its entirety a capping machine of the rotary type with several capping heads, for capping containers 2 with crown caps supplied by a feeding device of the known type and not illustrated.

The caps are fed underneath a first movable element 4 provided at the bottom with a magnet 5 which attracts the caps.

The first movable element 4, which is coaxial with the capping axis, is connected by means of an arm 6 to a first piston 7, the vertical positioning of which is regulated by a roller 22 sliding on a cam 8 having the shape of a circular segment.

The bottom part of the first movable element 4 is inserted inside a second movable element 9 which has the function of centering and capping bell member and which is connected by means of an arm 10 (which may be formed as one piece with the element 9) to a second piston 11, the vertical movement of which is regulated by a cam 12 on which a roller wheel 13 associated with the second piston 11 runs.

The first movable element 4 and the second movable element 9 are coaxial with the capping axis, indicated by 20 in FIG. 1, and are eccentric with respect to the first piston 7 and the second piston 11 so that operations involving cleaning of the pistons 7 and 11 (and any leakages of liquid or lubricating substances) do not adversely affect the hygiene of the capping zone, which is displaced laterally.

Means, not illustrated since they are of the known type, are provided in order to compensate for any slight variations in the height of the containers, equivalent to about ±7 mm.

The cams 8 and 12 are formed so that:

during a first step (step A in FIG. 2) both the movable elements 4 and 9 are located in a position in which the cap, supplied by the cap feeding device, is automatically attracted by the magnet 5;

during a second step (step B in FIG. 2) the first movable element, in an original manner, is raised inside the second movable element 9 (but in a variation of embodiment described below and illustrated in FIG. 3, it may be envisaged that the second movable element 9 moves downwards with respect to the first movable element 4) so that the cap, if it is not correctly positioned at the base of the first movable element 4, is positioned correctly, this being favoured by the raising movement inside a conical recess 14 provided internally in the bottom part of the second movable element 9;

during a third step (step C in FIG. 2) the container 2 is inserted below the movable elements 4 and 9;

during a fourth step (step D in FIG. 2) the two movable elements 4 and 9 move downwards onto the container until the first movable element 4 stops on the container so as to rest the cap on the mouth of the container;

during a fifth step (step E in FIG. 2) the second movable element 9 integral with 11 moves downwards with respect to the first movable element 4 (which in the meantime is locked against the mouth of the container) so as to embrace the mouth of the container and perform capping thereof.

After the fifth step, the movable elements move upwards again (step F in FIG. 2), allowing the capped container to exit.

It is considered unnecessary to describe the profile of the cams 8 and 12 since the person skilled in the art, who is required to perform the succession of steps indicated above, certainly knows how to form the cams accordingly.

16 denotes a first spring, inserted inside the second piston 11, while 17 denotes a second spring which has the function of recalling upwards the first piston 7 together with the first movable element 4.

Centering is performed without the container, the cap being completely free to move upwards inside the conical recess and arrange itself in the correct position on the first movable element 4.

Means are provided—not illustrated since they are of the known type—which, when no container 2 is present, remove the cap of from the magnet 5, before feeding of the next cap.

The container 2 is fed in a known manner onto a plate 15 provided with means for compensating for any variations in height of the containers.

The first and second pistons 7 and 11 are eccentric with respect to the capping axis and are positioned above the capping zone, in a non-interfering position such as to favour the operations of maintenance and cleaning of the capping machine.

Figure 2:
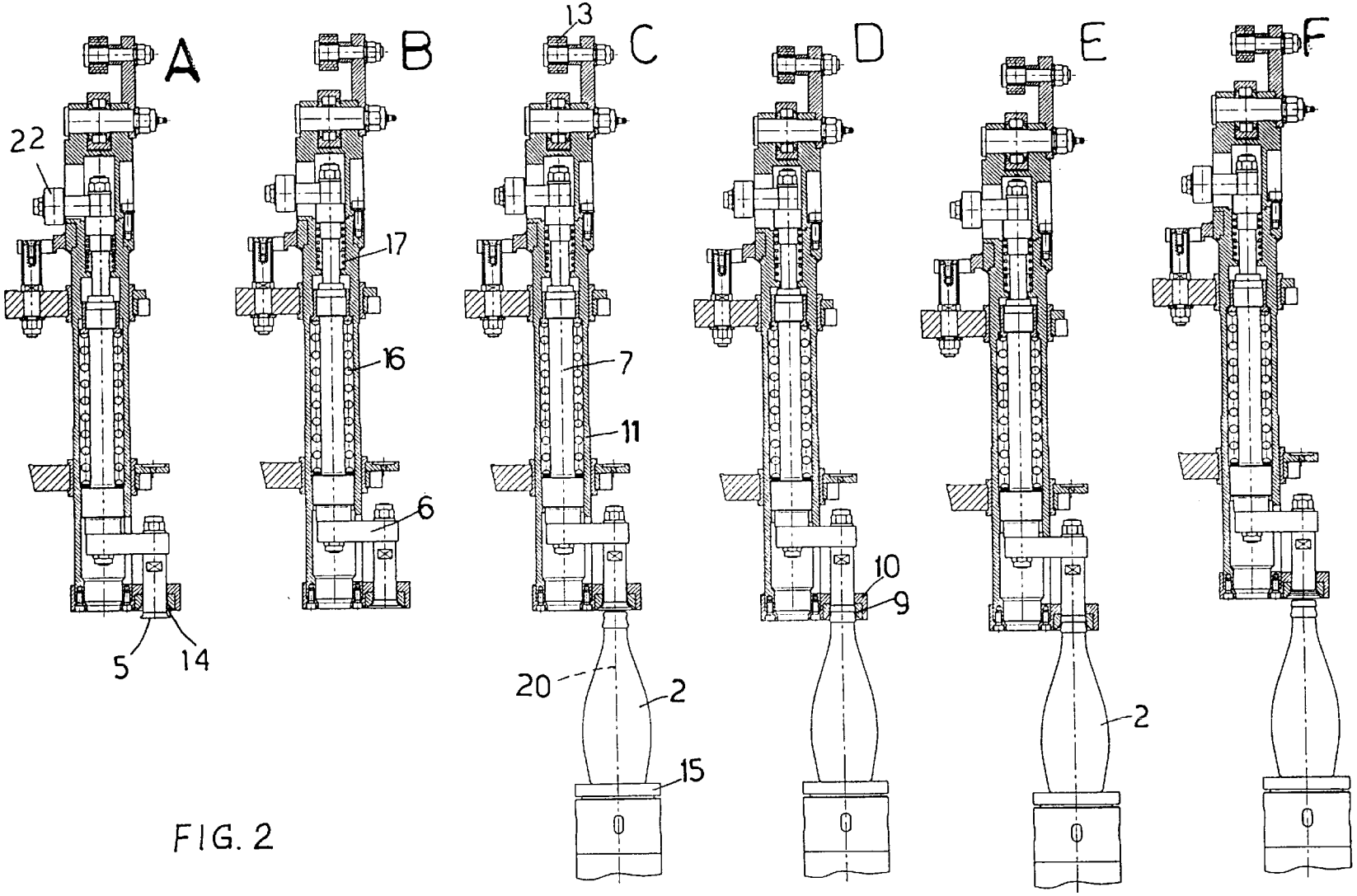
FIG. 2 illustrates the various steps of the capping method.
Figure 3:
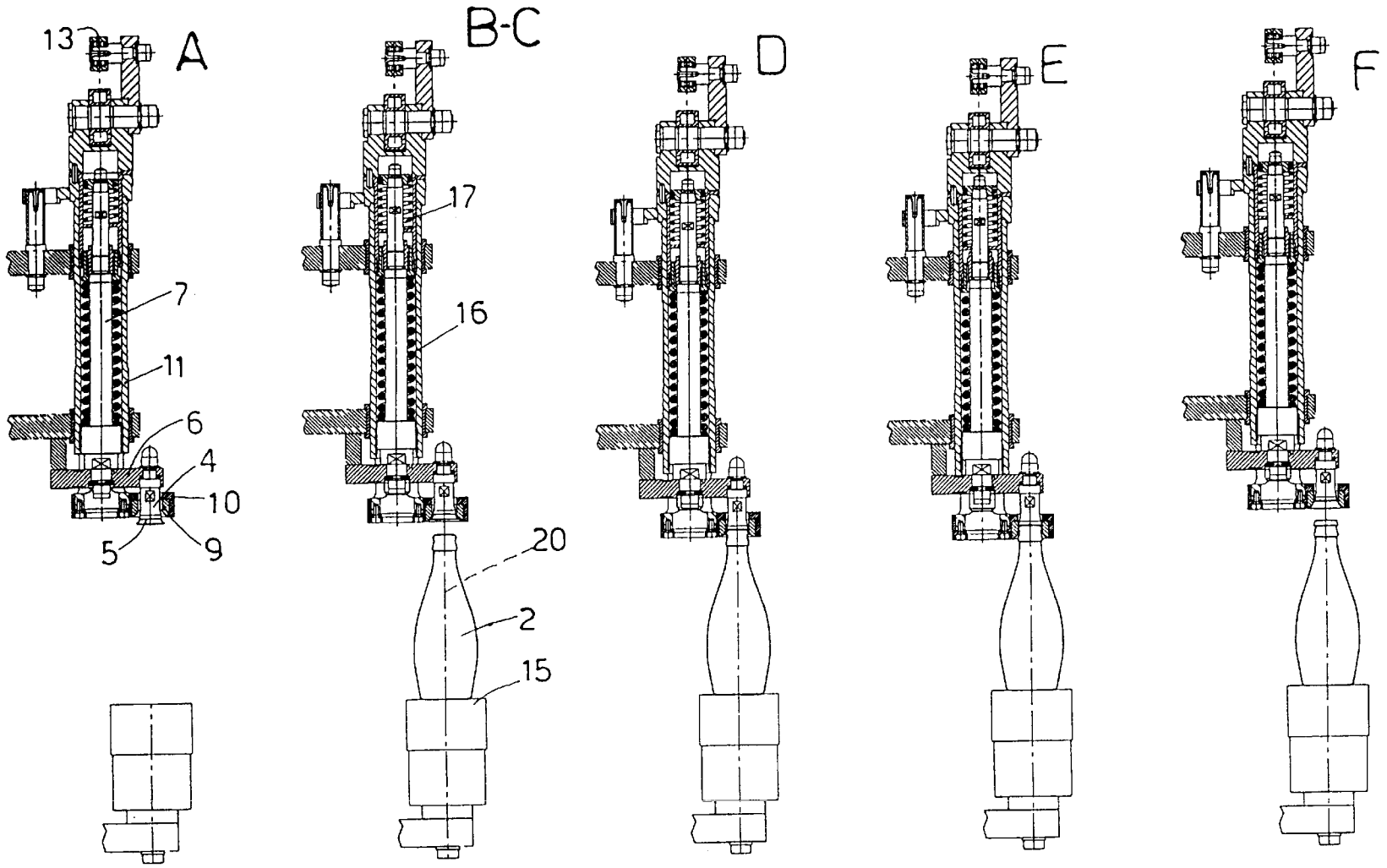
FIG. 3 illustrates the various steps of FIG. 2 according to a variant.

According to a variation of embodiment illustrated in FIG. 3, the vertical positioning of the first piston 7 is regulated by the roller wheel 13 running on a cam not illustrated and formed so that running of the roller wheel 13 on the cam produces the movements which, in the version described and illustrated above in FIGS. 1 and 2, are produced by the roller wheel 13 running on the cam 12 and by the roller 22 running on the cam 8. According to the variation of embodiment, therefore, use of the roller 22 and the cam 8 may be avoided.

In the variation of embodiment according to FIG. 3, the letters A to F are used to indicate the steps corresponding to the steps A to F of FIG. 2. In the example according to FIG. 3, the second movable element 9 moves downwards during step B with respect to the first movable element 4 so as to perform pre-centering of the cap.

What is claimed is:

1. Capping machine, for capping containers with crown caps, of rotary type provided with a plurality of capping heads, each of which comprises:

a first movable element coaxial with the capping axis and carrying at the bottom a magnet for attracting a cap;

a second movable element coaxial with the capping axis and sliding outside the first movable element, together therewith and with respect thereto;

means for actuating the first and the second movable element, said means being eccentric with respect to the capping axis;

wherein said means are positioned at a higher level than a container capping zone and consist of a first piston and a second piston which are coaxial with one another and connected to the first and the second movable element by arms.

2. Capping machine according to claim 1, wherein the arm (6) and a supporting frame of the capping machine are shaped in such a way as to interact one against the other as a stop run.

* * * * *